US008682679B2

(12) United States Patent
Breebaart

(10) Patent No.: US 8,682,679 B2
(45) Date of Patent: Mar. 25, 2014

(54) BINAURAL OBJECT-ORIENTED AUDIO DECODER

(75) Inventor: Dirk Jeroen Breebaart, Eindhoven (NL)

(73) Assignee: Koninklijke Philips N.V., Eindhoven (NL)

( * ) Notice: Subject to any disclaimer, the term of this patent is extended or adjusted under 35 U.S.C. 154(b) by 1006 days.

(21) Appl. No.: 12/665,106

(22) PCT Filed: Jun. 23, 2008

(86) PCT No.: PCT/IB2008/052469

§ 371 (c)(1), (2), (4) Date: Dec. 17, 2009

(87) PCT Pub. No.: WO2009/001277

PCT Pub. Date: Dec. 31, 2008

(65) Prior Publication Data

US 2010/0191537 A1 Jul. 29, 2010

(30) Foreign Application Priority Data

Jun. 26, 2007 (EP) ..... 07111073

(51) Int. Cl.
*G10L 19/00* (2013.01)

(52) U.S. Cl.
USPC ..... 704/500

(58) Field of Classification Search
USPC ..... 704/222, 230, 500–504
See application file for complete search history.

(56) References Cited

U.S. PATENT DOCUMENTS

| | | | | |
|---|---|---|---|---|
| 5,715,317 | A | 2/1998 | Nakazawa | |
| 6,421,446 | B1 * | 7/2002 | Cashion et al. | 381/17 |
| 6,498,857 | B1 * | 12/2002 | Sibbald | 381/310 |
| 7,085,393 | B1 * | 8/2006 | Chen | 381/310 |
| 7,876,903 | B2 * | 1/2011 | Sauk | 381/17 |
| 8,005,244 | B2 * | 8/2011 | Chanda et al. | 381/310 |
| 2006/0133628 | A1 * | 6/2006 | Trivi et al. | 381/310 |
| 2009/0041254 | A1 * | 2/2009 | Jin et al. | 381/1 |

FOREIGN PATENT DOCUMENTS

| | | | |
|---|---|---|---|
| WO | 9931938 | A1 | 6/1999 |
| WO | 2007045016 | A1 | 4/2007 |

OTHER PUBLICATIONS

Jot et al: "Binaural Simulation of Complex Acoustic Scenes for Interactive Audio"; Proceedings of the 121st Audio Engineering Society Conference, Oct. 2006, Convention Paper 6950, 20 Page Document.

(Continued)

*Primary Examiner* — Abul Azad

(57) ABSTRACT

A binaural object-oriented audio decoder including a decoder device to decode and render an audio object based on head-related transfer function (HRTF) parameters. The decoder device positions an audio object in a virtual three-dimensional space. The HRTF parameters are based on elevation, azimuth, and distance parameters and correspond to the position of the audio object in the virtual three-dimensional space. The binaural object-oriented audio decoder is configured to receive the HRTF parameters that vary for the elevation and azimuth parameters only. The binaural object-oriented audio decoder further includes a distance processor for modifying the received HRTF parameters according to a received desired distance parameter. The modified HRTF parameters are used to position the audio object in the three-dimensions at the desired distance. The modification of the HRTF parameters is based on a predetermined distance parameter for the received HRTF parameters.

12 Claims, 3 Drawing Sheets

(56) References Cited

OTHER PUBLICATIONS

Jot et al: "Scene Description Model and Rendering Engine for Interactive Virtual Acoustics"; Proceedings From the 120th Audio Engineering Society Conference, May 2006, Convention Paper 6660,13 Page Document.
Goodwin et al: "Binaural 3-D Audio Rendering Based on Spatial Audio Scene Coding"; Proceedings of the 123rd Audio Engineering Society, Oct. 2007, Convention Paper 7277, 12 Page Document.
Herre et al: "MPEG Surround—The ISO/MPEG Standard for Efficient and Compatible Multi-Channel Audio Coding"; Proceedings of the 122nd Audio Engineering Society, May 2007, Convention Paper 7084, 23 Page Document.
Brungart: "Control of Perceived Distance in Virtual Audio Displays"; Proceedings of the 20th Annual International Conference of the IEEE Engineering in Medicine and Biology Society, vol. 20, No. 3, 1998, pp. 1101-1104.
Plogsties et al: "MPEG Surround Binaural Rendering-Surround Sound for Mobile Devices"; 24th Tonmeristertagung-VDT International Convention, Nov. 2006, 19 Page Document.
Duraiswami et al: "Interpolation and Range Extrapolation of HRTFS"; ICASSP 2004, pp. 45-48.
Kan et al: "Psychoacoustic Evaluation of a New Method for Simulating Near-Field Virtual Auditory Space"; Proceedings of the 120th Audio Engineering Society, May 2006, Convention Paper 6801, 8 Page Document.
Breebaart et al: "Parametric Coding of Stereo Audio"; EURASIP Journal on Applied Signal Processing 2005, Issue 9, pp. 1305-1322.
Breebaart et al: "Multi-Channel Goes Mobile: MPEG Surround Binaural Rendering"; AES 29th International Conference, Sep. 2006, 13 Page Document.
Wightman et al: "Headphone Simulation of Free-Field Listening. I:Stimulus Synthesis"; Acoustical Society of America, vol. 85, 1989, pp. 858-867.

* cited by examiner

BINAURAL OBJECT-ORIENTED AUDIO DECODER

FIELD OF THE INVENTION

The invention relates to a binaural object-oriented audio decoder comprising decoding means for decoding and rendering at least one audio object based on head-related transfer function parameters, said decoding means being arranged for positioning an audio object in a virtual three-dimensional space, said head-related transfer function parameters being based on an elevation parameter, an azimuth parameter, and a distance parameter, said parameters corresponding to the position of the audio object in the virtual three-dimensional space, whereby the binaural object-oriented audio decoder is configured for receiving the head-related transfer function parameters, said received head-related transfer function parameters varying for the elevation parameter and the azimuth parameter only.

BACKGROUND OF THE INVENTION

Three-dimensional sound source positioning is gaining more and more interest. This is especially true for the mobile domain. Music playback and sound effects in mobile games can add a significant experience for a consumer when positioned in the three-dimensional space. Traditionally, the three-dimensional positioning employs so-called head-related transfer functions (HRTFs), as described in F. L. Wightman and D. J. Kistler, "Headphone simulation of free-field listening. I. Stimulus synthesis" J. Acoust. Soc. Am., 85:858-867, 1989.

These functions describe a transfer from a certain sound source position to eardrums by means of an impulse response or head-related transfer function.

Within the MPEG standardization body a three-dimensional binaural decoding and rendering method is being standardized. This method comprises generation of a binaural stereo output audio from either a conventional stereo input signal, or from a mono input signal. This so-called binaural decoding method is known from Breebaart, J., Herre, J., Villemoes, L., Jin, C., Kjörling, K., Plogsties, J., Koppens, J. (2006), "Multi-channel goes mobile: MPEG Surround binaural rendering", Proc. 29th AES conference, Seoul, Korea. In general, the head-related transfer functions as well as their parametric representations vary as a function of an elevation, an azimuth, and a distance. To reduce an amount of measurement data, however, the head-related transfer function parameters are mostly measured at a fixed distance of about 1 to 2 meters. Within the three-dimensional binaural decoder that is being developed, an interface is defined for providing the head-related transfer function parameters to said decoder. In this way, the consumer can select different head-related transfer functions or provide his/her own ones. However, the current interface has a disadvantage that it is defined for a limited set of elevation and/or azimuth parameters only. This means that an effect of positioning sound sources at different distances is not included and the consumer cannot modify the perceived distance of the virtual sound sources. Furthermore, even if the MPEG Surround standard would provide an interface for head-related transfer function parameters for different elevation and distance values, the required measurement data are in many cases not available since HRTFs are in most cases measured at a fixed distance only and their dependence on distance is not known a priori.

SUMMARY OF THE INVENTION

It is an object of the invention to provide an enhanced binaural object-oriented audio decoder that allows an arbitrary virtual positioning of objects in a space.

The binaural object-oriented audio decoder comprises decoding means for decoding and rendering at least one audio object. Said decoding and rendering are based on head-related transfer function parameters. Said decoding and rendering (often combined in one stage) is used to position the decoded audio object in a virtual three-dimensional space. The head-related transfer function parameters are based on an elevation parameter, an azimuth parameter, and a distance parameter. These parameters correspond to the (desired) position of the audio object in the three-dimensional space. The binaural object-oriented audio decoder is configured for receiving the head-related transfer function parameters that are varying for the elevation parameter and the azimuth parameter only.

To overcome the disadvantage that the distance effect on head-related transfer function parameters is not provided the invention proposes to modify the received head-related transfer function parameters according to a received desired distance. Said modified head-related transfer function parameters are used to position an audio object in the three-dimensional space at the desired distance. Said modification of the head-related transfer function parameters is based on a predetermined distance parameter for said received head-related function parameters.

The advantage of the binaural object-oriented audio decoder according to the invention is that the head-related transfer function parameters can be extended by the distance parameter that is obtained by modifying said parameters from the predetermined distance to the desired distance. This extension is achieved without explicit provisioning of the distance parameter that was used during the determination of the head-related transfer function parameters. This way the binaural object-oriented audio decoder becomes free from the inherent limitation of using the elevation and azimuth parameters only. This property is of considerable value since most of head-related transfer function parameters do not incorporate a varying distance parameter at all, and measurement of the head-related transfer function parameters as a function of an elevation, an azimuth, and a distance is very expensive and time-consuming. Furthermore, the amount of data required to store the head-related transfer function parameters is greatly reduced when the distance parameter is not included.

Further advantages are as follows. With the proposed invention an accurate distance processing is achieved with a very limited computational overhead. The user can modify the perceived distance of the audio object on the fly. The modification of the distance is performed in the parameter domain, which results in significant complexity reduction when compared to distance modification operating on the head-related transfer function impulse response (when applying conventional three-dimensional synthesis methods). Moreover, the distance modification can be applied without availability of the original head-related impulse responses.

In an embodiment, the distance processing means are arranged for decreasing the level parameters of the head-related function parameters with an increase of the distance parameter corresponding to the audio object. With this embodiment the distance variation properly influences the head-related transfer function parameters as it actually does happen in reality.

In an embodiment, the distance processing means are arranged for using scaling by means of scalefactors, said scalefactors being a function of the predetermined distance parameter, and the desired distance. The advantage of the scaling is that the computational effort is limited to the scale factor computation and a simple multiplication. Said multiplication is a very simple operation that does not introduce large computational overhead.

In an embodiment, said scale factor is a ratio of the predetermined distance parameter and the desired distance. Such way of computing the scale factor is very simple and is sufficiently accurate.

In an embodiment, said scalefactors are computed for each of the two ears, each scale factor incorporating path-length differences for the two ears. This way of computing the scalefactors provides more accuracy for distance modeling/modification.

In an embodiment, the predetermined distance parameter takes a value of approximately 2 meters. As mentioned before in order to reduce an amount of measurement data, the head-related transfer function parameters are mostly measured at a fixed distance of about 1 to 2 meters, since it is known that from 2 meters onwards, inter-aural properties of HRTFs are virtually constant with distance.

In an embodiment, the desired distance parameter is provided by an object-oriented audio encoder. This allows the decoder to properly reproduce the location of the audio objects in the three-dimensional space.

In an embodiment, the desired distance parameter is provided through a dedicated interface by a user. This allows the user to freely position the decoded audio objects in the three-dimensional space as he/she wishes.

In an embodiment, the decoding means comprise a decoder in accordance with the MPEG Surround standard. This property allows a re-use of the existing MPEG Surround decoder, and enables said decoder to gain new features that otherwise are not available.

The invention further provides method Claims as well as a computer program product enabling a programmable device to perform the method according to the invention.

BRIEF DESCRIPTION OF THE DRAWINGS

These and other aspects of the invention will be apparent from and elucidated with reference to the embodiments shown in the drawings, in which.

Throughout the Figures, same reference numerals indicate similar or corresponding features. Some of the features indicated in the drawings are typically implemented in software, and as such represent software entities, such as software modules or objects.

DETAILED DESCRIPTION OF THE EMBODIMENTS

Figure 1:
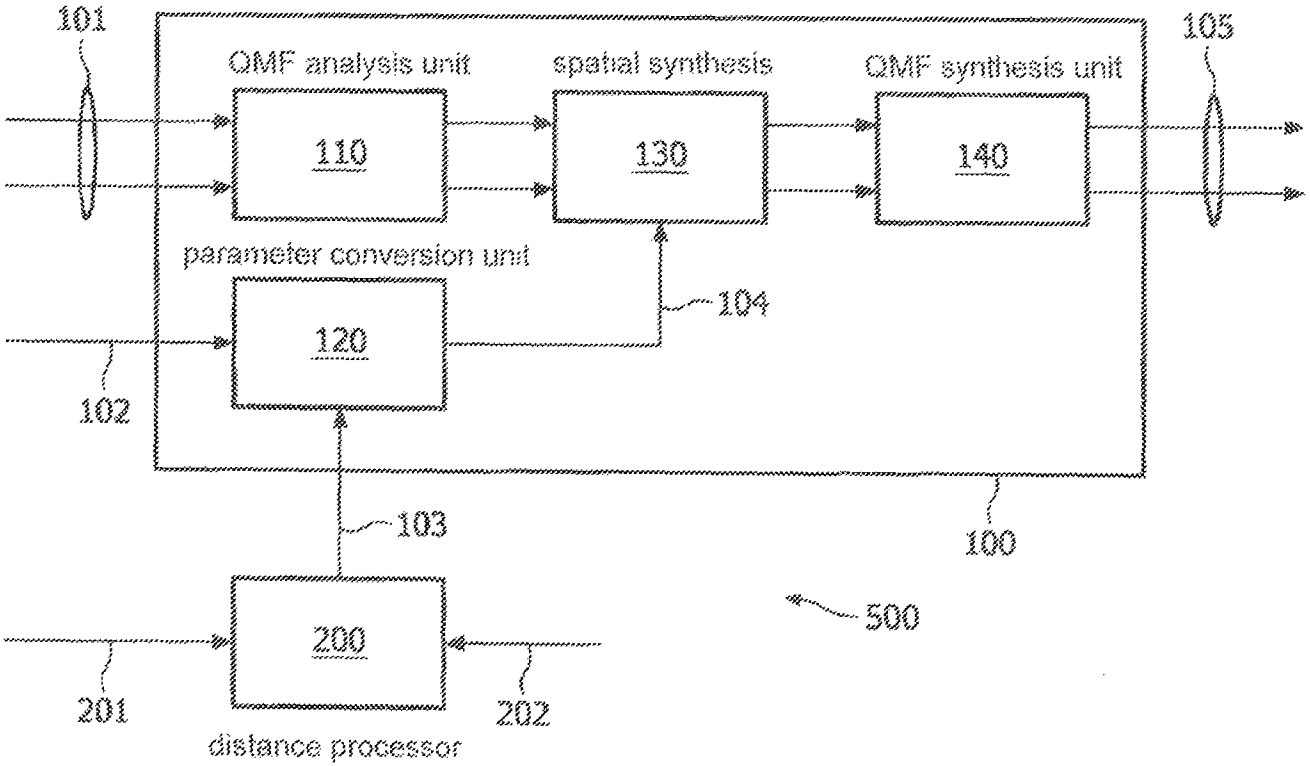
FIG. 1 schematically shows an object-oriented audio decoder comprising distance processing means for modifying the head-related transfer function parameters for a predetermined distance parameter into a new head-related transfer function parameters for the desired distance.

FIG. 1 schematically shows an object-oriented audio decoder 500 comprising distance processing means 200 for modifying the head-related transfer function parameters for a predetermined distance parameter into a new head-related transfer function parameters for the desired distance. A decoder device 100 represents currently standardized binaural object-oriented audio decoder. Said decoder device 100 comprises decoding means for decoding and rendering at least one audio object based on head-related transfer function parameters. Example decoding means comprise a QMF analysis unit 110, a parameter conversion unit 120, a spatial synthesis 130, and a QMF synthesis unit 140. Details of binaural object-oriented decoding are provided in Breebaart, J., Herre, J., Villemoes, L., Jin, C., Kjörling, K., Plogsties, J., Koppens, J. (2006), "Multi-channel goes mobile: MPEG Surround binaural rendering", Proc. 29th AES conference, Seoul, Korea, and ISO/IEC JTC1/SC29/WG11 N8853: "Call for proposals on Spatial Audio Object Coding"

As down-mix 101 is fed into decoding means that decode and render the audio objects from the down-mix based on the object parameters 102 and head-related transfer function parameters, as provided to the parameter conversion unit 120. Said decoding and rendering (often combined in one stage) position the decoded audio object in a virtual three-dimensional space.

More specifically the down-mix 101 is fed into the QMF analysis unit 110. The processing performed by this unit is described in Breebaart, J., van de Par, S., Kohlrausch, A., and Schuijers, E. (2005). Parametric coding of stereo audio. Eurasip J. Applied Signal Proc., issue 9: special issue on anthropomorphic processing of audio and speech, 1305-1322.

The object parameters 102 are fed into the parameter conversion unit 120. Said parameter conversion unit converts the object parameters based on the received HRTF parameters into binaural parameters 104. The binaural parameters comprise level differences, phase differences and coherence values that result from one or more object signals simultaneously that all have its own position in the virtual space. Details on the binaural parameters are found in Breebaart, J., Herre, J., Villemoes, L., Jin, C., Kjörling, K., Plogsties, J., Koppens, J. (2006), "Multi-channel goes mobile: MPEG Surround binaural rendering", Proc. 29th AES conference, Seoul, Korea, and Breebaart, J., Faller, C. "Spatial audio processing: MPEG Surround and other applications", John Wiley & Sons, 2007.

The output of the QMF analysis unit and the binaural parameters are fed into the spatial synthesis unit 130. The processing performed by this unit is described in Breebaart, J., van de Par, S., Kohlrausch, A., and Schuijers, E. (2005). Parametric coding of stereo audio. Eurasip J. Applied Signal Proc., issue 9: special issue on anthropomorphic processing of audio and speech, 1305-1322. Subsequently, the output of the spatial synthesis unit 130 is fed into the QMF synthesis unit 140, which generates three dimensional stereo output 105.

The head-related transfer function (HRTF) parameters are based on an elevation parameter, an azimuth parameter, and a distance parameter. These parameters correspond to the (desired) position of the audio object in the three-dimensional space.

Within the binaural object-oriented audio decoder 100 that has been developed, an interface to the parameter conversion unit 120 is defined for providing the head-related transfer function parameters to said decoder. However, the current interface has a disadvantage that it is defined for a limited set of elevation and/or azimuth parameters only.

To enable the distance effect on head-related transfer function parameters the invention proposes to modify the received head-related transfer function parameters according to a received desired distance parameter. Said modification of the HRTF parameters is based on a predetermined distance parameter for said received HRTF parameters. This modification takes place in distance processing means 200. The HRTF parameters 201 together with the desired distance per audio object 202 are fed into the distance processing means 200. The modified head-related transfer function parameters 103 as generated by said distance processing means are fed into the parameter conversion unit 120 and they are used to position an audio object in the virtual three-dimensional space at the desired distance.

The advantage of the binaural object-oriented audio decoder according to the invention is that the head-related transfer function parameters can be extended by the distance parameter that is obtained by modifying said parameters from the predetermined distance to the desired distance. This extension is achieved without explicit provisioning of the distance parameter that was used during the determination of the head-related transfer function parameters. This way the binaural object-oriented audio decoder 500 becomes free from the inherent limitation of using the elevation and azimuth parameters only, as it is in the case of the decoder device 100. This property is of considerable value since most of head-related transfer function parameters do not incorporate a varying distance parameter at all, and measurement of the head-related transfer function parameters as a function of an elevation, an azimuth, and a distance is very expensive and time-consuming. Furthermore, the amount of data required to store the head-related transfer function parameters is greatly reduced when the distance parameter is not included.

Further advantages are as follows. With the proposed invention an accurate distance processing is achieved with a very limited computational overhead. The user can modify the perceived distance of the audio object on the fly. The modification of the distance is performed in the parameter domain, which results in significant complexity reduction when compared to distance modification operating on the head-related transfer function impulse response (when applying conventional three-dimensional synthesis methods). Moreover, the distance modification can be applied without availability of the original head-related impulse responses.

Figure 2:
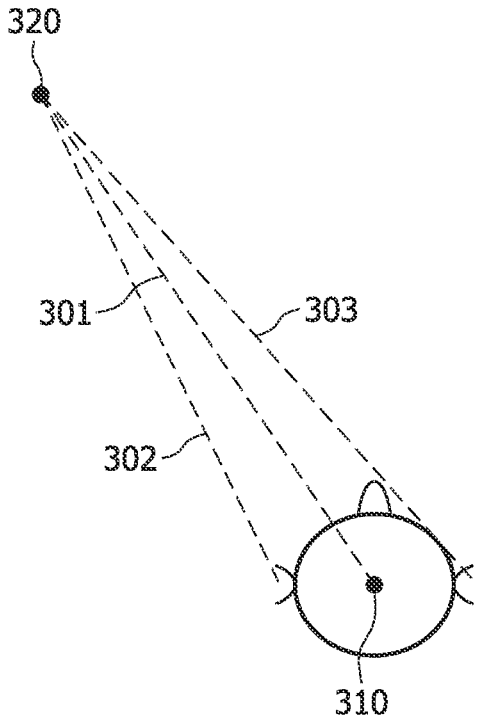
FIG. 2 schematically shows an ipsilateral ear, a contralateral ear, and a perceived position of the audio object.

FIG. 2 schematically shows an ipsilateral ear, a contra lateral ear, and a perceived position of the audio object. The audio object is virtually positioned at location 320. Said audio object is differently perceived by the ipsilateral (=left) and the contra lateral (=right) ear of the user depending on the distance 302 and 303 of each ear, respectively, to the audio object. The reference distance 301 of the user is measured from the center of the interval between the ipsilateral and the contra lateral ear to the position of the audio object.

In an embodiment, the head-related transfer function parameters comprises at least a level for an ipsilateral ear, a level for contra lateral ear, and a phase difference between the ipsilateral and contra lateral ears, said parameters determining the perceived position of the audio object. These parameters are determined for each combination of frequency band index b, elevation angle e and azimuth angle a. The level for an ipsilateral ear is denoted by $P_i(a,e,b)$, the level for contra lateral ear by $P_c(a,e,b)$, and the phase difference between the ipsilateral and contra lateral ears $\phi(a,e,b)$. Detailed information about HRTFs can be found in F. L. Wightman and D. J. Kistler, "Headphone simulation of free-field listening. I. Stimulus synthesis" J. Acoust. Soc. Am., 85:858-867, 1989. The level parameters per frequency band facilitate both elevation (due to specific peaks and troughs in the spectrum) as well as level differences for azimuth (determined by the ratio of the level parameters for each band). The absolute phase values or phase difference values capture arrival time differences between both ears, which are also important cues for audio object azimuth.

The distance processing means 200 receive the HRTF parameters 201 for a given elevation angle e, an azimuth angle a, and frequency band b, as well as a desired distance d, depicted by the numeral 202. The output of the distance processing means 200 comprises modified HRTF parameters $P_i'(a,e,b)$, $P_c'(a,e,b)$ and $\phi'(a,e,b)$ that are used as input 103 to the parameter conversion unit 120:

$$\{P'_i(a,e,b),P'_c(a,e,b),\phi'(a,e,b)\}=D(P_i(a,e,b),P_c(a,e,b),\phi(a,e,b),d),$$

where the index i is used for ipsilateral ear, and the index c for contra lateral ear, d the desired distance and the function D represents the necessary modification processing. It should be noted that only the levels are modified as the phase difference does not change with the change of the distance to the audio object.

In an embodiment, the distance processing means are arranged for decreasing the level parameters of the head-related function parameters with an increase of the distance parameter corresponding to the audio object. With this embodiment the distance variation properly influences the head-related transfer function parameters as it actually does happen in reality.

In an embodiment, the distance processing means are arranged for using scaling by means of scalefactors, said scalefactors being a function of the predetermined distance parameter $d_{ref}$ 301, and the desired distance d:

$$P'_x(a,e,b)=g_x(a,e,b,d)P_x(a,e,b),$$

where index X of the level takes value i or c for ipsilateral and contra lateral ears, respectively.

The scalefactors $g_i$ and $g_c$ result from a certain distance model G(a,e,b,d) that predicts the change in the HRTF parameters $P_x$ as a function of distance:

$$g_x(a, e, b, d) = \frac{G(a, e, b, d)}{G(a, e, b, d_{ref})},$$

with d the desired distance and $d_{ref}$ the distance of the HRTF measurements 301. The advantage of the scaling is that the computational effort is limited to the scale factor computation and a simple multiplication. Said multiplication is a very simple operation that does not introduce a large computational overhead.

In an embodiment, said scale factor is a ratio of the predetermined distance parameter $d_{ref}$ and the desired distance d:

$$g(a, e, b, d) = \frac{d_{ref}}{d}.$$

Such way of computing the scale factor is very simple and is sufficiently accurate.

In an embodiment, said scalefactors are computed for each of the two ears, each scale factor incorporating path-length differences for the two ears, namely the difference between 302 and 303. The scalefactors for the ipsilateral and contra lateral ear are then expressed as:

$$g_i(a, e, b, d) = \frac{d_{ref}}{d - \sin(a)\cos(e)\beta},$$

$$g_c(a, e, b, d) = \frac{d_{ref}}{d + \sin(a)\cos(e)\beta},$$

with β the radius of the head (typically 8 to 9 cm). This way of computing the scalefactors provides more accuracy for distance modeling/modification.

Alternatively, the function D is not implemented as a multiplication as a scale factor $g_i$ applied on the HRTF parameters $P_i$ and $P_c$ but is a more general function that decreases the value of $P_i$ and $P_c$ with an increase of the distance, for example:

$$P'_x(a, e, b) = \frac{P_x(a, e, b)}{d},$$

$$P'_x(a, e, b) = P_x^{-d}(a, e, b),$$

$$P'_x(a, e, b) = \frac{P_x(a, e, b)}{d + \varepsilon},$$

with $\epsilon$ a variable to influence the behavior at very small distances and to prevent division by zero.

In an embodiment, the predetermined distance parameter takes a value of approximately 2 meters, see for explanation for this assumption A. Kan, C. Jin, A. van Schaik, "Psychoacoustic evaluation of a new method for simulating near-field virtual auditory space", Proc. 120$^{th}$ AES convention, Paris, France (2006). As mentioned before in order to reduce an amount of measurement data, the head-related transfer function parameters are mostly measured at a fixed distance of about 1 to 2 meters. It should be noted that variation of distance in the range 0 to 2 meters results in significant parameter changes of the head-related transfer function parameters.

In an embodiment, the desired distance parameter is provided by an object-oriented audio encoder. This allows the decoder to properly reproduce the location of the audio objects in the three-dimensional space as it was at the time of the recording/encoding.

In an embodiment, the desired distance parameter is provided through a dedicated interface by a user. This allows the user to freely position the decoded audio objects in the three-dimensional space as he/she wishes.

In an embodiment, the decoding means 100 comprise a decoder in accordance with the MPEG Surround standard. This property allows a re-use of the existing MPEG Surround decoder, and enables said decoder to gain new features that otherwise are not available.

Figure 3:
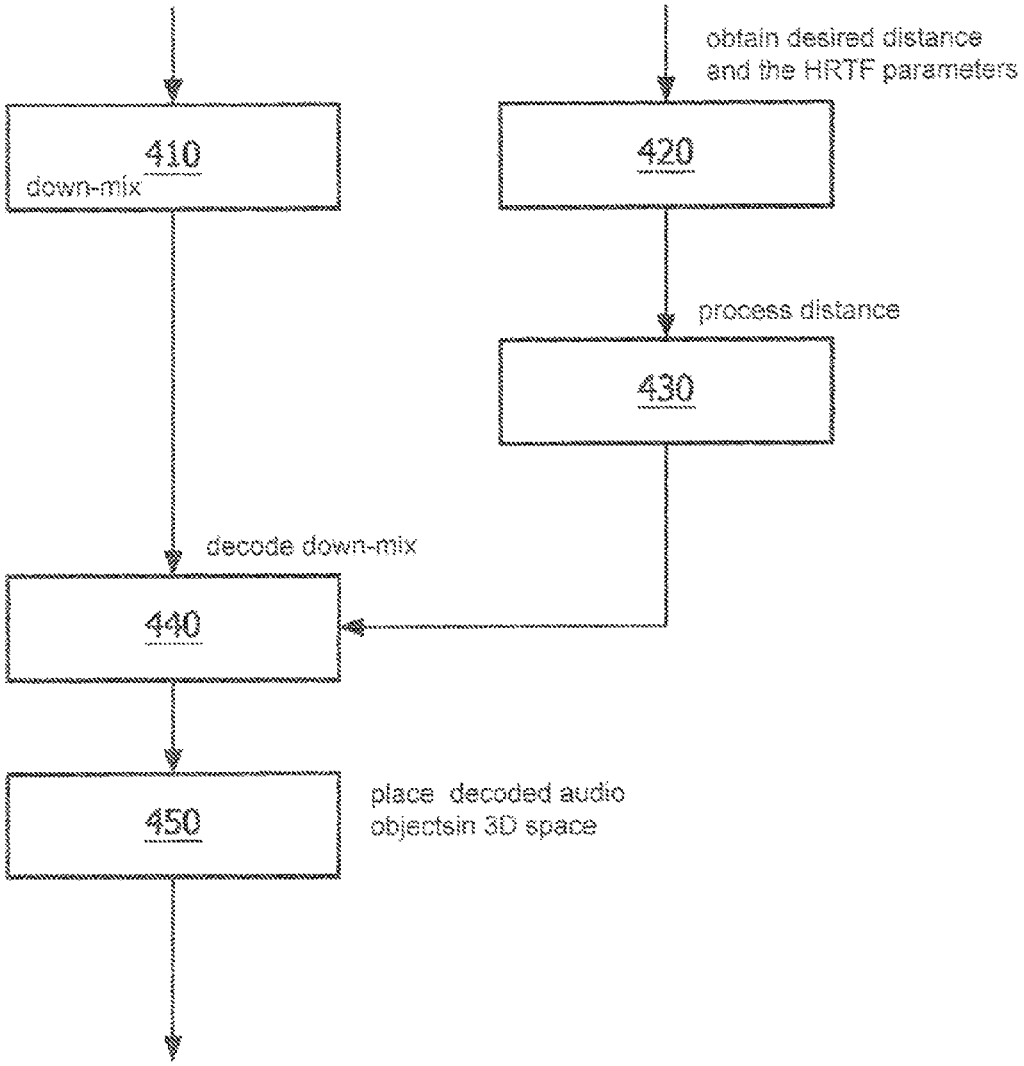
FIG. 3 shows a flow chart for a method of decoding in accordance with some embodiments of the invention.

FIG. 3 shows a flow chart for a method of decoding in accordance with some embodiments of the invention. In a step 410 the down-mix with the corresponding object parameters are received. In a step 420 the desired distance and the HRTF parameters are obtained. Subsequently the step 430 the distance processing is performed. As the result of this step the HRTF parameters for a predetermined distance parameter are converted into modified HRTF parameters for the received desired distance. In step 440 the received down-mix is decoded based on the received object parameters. In step 450 the decoded audio objects are placed in the three-dimensional space according to the modified HRTF parameters. The last two steps can be combined in one step for efficiency reasons.

In an embodiment, a computer program product executes the method according to the invention.

In an embodiment, an audio playing device comprises a binaural object-oriented audio decoder according to the invention.

It should be noted that the above-mentioned embodiments illustrate rather than limit the invention, and those skilled in the art will be able to design many alternative embodiments without departing from the scope of the appended Claims.

In the accompanying Claims, any reference signs placed between parentheses shall not be construed as limiting the Claim. The word "comprising" does not exclude the presence of elements or steps other than those listed in a Claim. The word "a" or "an" preceding an element does not exclude the presence of a plurality of such elements. The invention can be implemented by means of hardware comprising several distinct elements, and by means of a suitably programmed computer.

The invention claimed is:

1. A binaural object-oriented audio decoder comprising:

a decoder device configured to decode and render an audio object based on head-related transfer function (HRTF) parameters, said decoder device being further configured to position the audio object in a virtual three-dimensional space, said HRTF parameters being based on an elevation parameter, an azimuth parameter, and a distance parameter corresponding to a position of the audio object in the virtual three-dimensional space; and a distance processor configured to receive the HRTF parameters and a desired distance parameter, said received HRTF parameters varying for the elevation parameter and the azimuth parameter only, wherein the distance parameter is fixed as a predetermined distance parameter, wherein the distance processor is further configured to modify the received HRTF parameters according to the received desired distance parameter, said modified HRTF parameters being used to position the audio object in three-dimensions at a perceived desired distance, wherein the modification of the HRTF parameters is based on the predetermined distance parameter for said received head-related function parameters, wherein the HRTF parameters comprise a phase difference between an ipsilateral ear and a contra lateral ear, and a plurality of parameters including at least a level parameter for the ipsilateral ear and a level parameter for the contra lateral ear, said plurality of parameters determining the perceived position of the audio object, and wherein the distance processor is further configured to decrease the plurality of parameters of the HRTF parameters with an increase of the distance parameter corresponding to the audio object.

2. The binaural object-oriented audio decoder as claimed in claim 1, wherein the distance processor is further configured to use scaling by scalefactors, said scalefactors being a function of the predetermined distance parameter, and the desired distance.

3. The binaural object-oriented audio decoder as claimed in claim 2, wherein said scale factor is a ratio of the predetermined distance parameter and the desired distance.

4. The binaural object-oriented audio decoder as claimed in claim 2, wherein said scalefactors are computed for each of the ipsilateral ear and the contra lateral ear, each scale factor incorporating path-length differences for the ipsilateral ear and the contra lateral ear.

5. The binaural object-oriented audio decoder as claimed in claim 1, wherein the predetermined distance parameter takes a value of approximately 2 meters.

6. The binaural object-oriented audio decoder as claimed in claim 1, wherein the desired distance parameter is provided by an object-oriented audio encoder.

7. The binaural object-oriented audio decoder as claimed in claim 1, wherein the desired distance parameter is provided through a dedicated interface by a user.

8. The binaural object-oriented audio decoder as claimed in claim 1, wherein the decoder device comprises a decoder in accordance with an MPEG Surround standard.

9. A method of decoding audio comprising the acts of:

receiving by a distance processor head-related transfer function (HRTF) parameters;

receiving by the distance processor a desired distance parameter;

decoding and rendering an audio object, based on the received HRTF parameters, said decoding and rendering comprising positioning an audio object in a virtual three-dimensional space, said received HRTF parameters being based on an elevation parameter, an azimuth parameter, and a distance parameter corresponding to a position of the audio object in the virtual three-dimensional space, said received HRTF parameters varying for the elevation parameter and the azimuth parameter only, wherein the distance parameter is fixed as a predetermined distance parameter;

modifying by the distance processor the received HRTF parameters according to the received desired distance parameter, said modified HRTF parameters being used to position the audio object in three-dimensions at the desired distance, wherein the modifying act is based on the predetermined distance parameter for said received head-related function parameters, wherein the HRTF parameters comprise a phase difference between an ipsilateral ear and a contra lateral ear, and a plurality of parameters including at least a level parameter for the ipsilateral ear and a level parameter for the contra lateral ear, said plurality of parameters determining a perceived position of the audio object; and decreasing by the distance processor the plurality of parameters of the HRTF parameters with an increase of the distance parameter corresponding to the audio object.

10. The method of decoding audio as claimed in claim 9, wherein the modifying act is performed through scaling by scalefactors, said scalefactors being a function of the predetermined distance parameter, and the desired distance.

11. The method of decoding audio as claimed in claim 9, wherein the decoding and the rendering acts are performed in accordance with a binaural MPEG Surround standard.

12. An audio playing device comprising a binaural object-oriented audio decoder, wherein the binaural object-oriented audio decoder comprising:

a decoder device configured to decode and render an audio object based on head-related transfer function (HRTF) parameters said decoder device being further configured to position the audio object in a virtual three-dimensional space, said HRTF parameters being based on an elevation parameter, an azimuth parameter, and a distance parameter corresponding to a position of the audio object in the virtual three-dimensional space; and a distance processor configured to receive the HRTF parameters and a desired distance parameter, said received HRTF parameters varying for the elevation parameter and the azimuth parameter only, wherein the distance parameter is fixed as a predetermined distance parameter, wherein the distance processor is further configured to modify the received HRTF parameters according to the received desired distance parameter, said modified HRTF parameters being used to position the audio object in three-dimensions at a perceived desired distance, wherein the modification of the HRTF parameters is based on the predetermined distance parameter for said received head-related function parameters, wherein the HRTF parameters comprise a phase difference between an ipsilateral ear and a contra lateral ear, and a plurality of parameters including at least a level parameter for the ipsilateral ear and a level parameter for the contra lateral ear, said plurality of parameters determining the perceived position of the audio object, and wherein the distance processor is further configured to decrease the plurality of parameters of the HRTF parameters with an increase of the distance parameter corresponding to the audio object.

* * * * *